United States Patent [19]

Gerstenberger et al.

[11] 4,275,521

[45] Jun. 30, 1981

[54] ELECTRO-MECHANICAL TRIGGERING MECHANISM FOR FIRE ARMS

[75] Inventors: Friedrich Gerstenberger, Dürnau; Wolfgang Loos, Munderkingen; Dieter Straub, Ulm, all of Fed. Rep. of Germany

[73] Assignee: J. G. Anschutz, GmbH, Fed. Rep. of Germany

[21] Appl. No.: 30,822

[22] Filed: Apr. 17, 1979

[30] Foreign Application Priority Data

Apr. 28, 1978 [DE] Fed. Rep. of Germany ..... 2818834

[51] Int. Cl.[3] ..... F41C 19/12

[52] U.S. Cl. ..... 42/84

[58] Field of Search ..... 42/84; 89/28 A, 28 R, 89/135

[56] References Cited

U.S. PATENT DOCUMENTS

| | | | |
|---|---|---|---|
| 2,780,882 | 2/1957 | Temple | 42/84 |
| 3,198,074 | 8/1965 | Perkins | 89/28 R |
| 3,208,181 | 9/1965 | Calhoun et al. | 42/84 |
| 3,899,845 | 8/1975 | Wild et al. | 42/84 |
| 3,982,347 | 9/1976 | Brandl et al. | 42/84 |

FOREIGN PATENT DOCUMENTS

| | | | |
|---|---|---|---|
| 1132826 | 7/1962 | Fed. Rep. of Germany | 42/84 |

*Primary Examiner*—Charles T. Jordan
*Attorney, Agent, or Firm*—Holman & Stern

[57] ABSTRACT

An electro-mechanical triggering mechanism for fire arms which comprises a signal receiver used as an input unit which converts a shot-triggering signal generated by the user pulling the trigger into an electrical signal and an electro-mechanical converter which forms an output unit, which unit receives the electrical signal from the input unit and acts on a shot-triggering element to initiate the shot. The improvement consists in that the electro-mechanical converter is an electrically or electro-magnetically deformable piezo-active element which is mechanically connected to the shot-triggering element to initiate the shot. The piezo-active element can be a cantilevered bending bar; a hollow body filled with piezo-active liquid which is capable of moving a piston or elastic membrane; or a bending bar having a series of longitudinally extending bores having electrically conductive walls throughout its middle. Moreover, the signal receiver can take the form of a potentiometer; variable capacitors; monolithically integrated touch key; piezo-resistive semi-conductor component; an inductive or capacitive approach switch; a photo-electric unit; or a semi-conductor element control by a magnetic field.

21 Claims, 13 Drawing Figures

ELECTRO-MECHANICAL TRIGGERING MECHANISM FOR FIRE ARMS

BACKGROUND OF THE INVENTION

The invention relates to an electro-mechanical triggering mechanism for fire arms, and particularly competition arms, comprising a signal receiver used as an input unit which converts a shot-triggering signal generated by the user into an electrical signal, an operational unit, provided only if required, for amplifying and/or converting this electrical signal, and an electromechanical converter forming an output unit of the triggering mechanism which converts the electrical signal into a mechanical signal which directly or via transmission elements releases a shot-triggering element held in a releasable manner by the triggering mechanism.

DISCUSSION OF THE PRIOR ART

Such triggering mechanisms are known in many embodiments (see, e.g., German Pat. No. 11 32 826; German Offenlegungsschrift No. 20 30 904; U.S. Pat. No. 2,780,882; U.S. Pat. No. 3,899,845). They have as an object the replacement of the purely mechanical triggering mechanism. The partially realized object in this is greater constructional freedom, more cost-effective production with respect to expensive mechanical triggering mechanisms, faster triggering times, an easier and simpler to control triggering process and the ability to implement different types of safety systems with little expenditure.

In the known electro-mechanical triggering mechanisms of this type the electro-mechanical converter provided as an output unit is without exception always an electromagnet with movable armature. Especially due to their inductance caused by the necessary soft iron cores and armatures, these electromagnets have a certain magnetic reluctance, i.e., their magnetic field is not built up immediately when the electric circuit is switched on, but slowly, and in the same way it does not collapse suddenly when the current is switched off.

These phenomena are caused by physical laws and are immutable. It is true that the excitation time of electromagnets can be reduced by making the magnets small. However, this also makes the achievable field strengths small and one has to be content with relatively short armature travel and small force exerted by the magnet. Magnets used directly for actuating the shot-triggering element, as shown in German Offenlegungsschrift No. 24 04 053, must be so strong and large that their inductance, which is then greater of necessity, requires a longer excitation period. Since this is a direct component of the actuation time of the shot, this effect is most undesirable with fire arms because an increased actuation time for the shot in general produces a deterioration in the hit results.

Even if an electromagnet, as mentioned initially, is used only to actuate a release pawl releasing the shot-triggering element proper and the size of the magnet, therefore, can be reduced, the excitation period is still long enough that the release times are extended with respect to purely mechanical triggering mechanisms, again increasing the actuation time, of which the triggering time is a part, in an undesirable way.

It is a further disadvantage of the electromagnet that electrical energy is required, in addition to the mechanical work required of the magnet, to build up and maintain the magnetic field. As is known, the energy stored in the magnetic field is reconverted into electrical current by self inductance on collapse of the field, but this can no longer be utilized advantageously and is lost, generating heat. In battery-fed electromagnets in fire arms this loss is of considerable importance since the batteries cannot be large, because of limited space, and their capacity is, therefore, quite limited. Their energy, to be given off in the form of electrical current, should thus be usable at as high a degree of efficiency as possible. In addition it is important that the power sources achieve long life in order to improve the operational readiness and relieability of the fire arms equipped with them.

SUMMARY OF THE INVENTION

This invention is based on the task to reduce the triggering time and the power consumption of the electromechanical triggering mechanism for fire arms.

According to the invention, this task is solved in that the electro-mechanical converter is an electrically or magnetically excitable piezo-electrical element with predetermined direction of action. In such a piezo-electrical element interactions take place between electrical or magnetic and elastomechanical force fields, i.e., on excitation by electrical or magnetic force fields an elastomechanical field of tension is generated in the interior of the piezo-electrical element, leading to a restorable deformation of the piezo-electrical element.

The designation "electro-mechanical converter" is also suitable for a piezo-active element to be excited magnetically, since every electric current generates a magnetic field which, in principle, can be used for excitation. It is true that permanent magnets can be used but this is impracticable due to the mechanically cumbersom and time-consuming way in which they must be manipulated. The exception to this are hybrid magnets which fall between purely permanent and electromagnets. Hybrid magnets have a cores of electrical exciter windings, ferrite rods, the magnetic behaviour of which is characterized by a rectangular hysteresis loop. Their magnetism arises suddenly by magnetic reversal of their molecular magnets once an extremely short pulse of exciter current of only a few $\mu$S duration has flowed through the exciter winding. Such magnets, therefore, are electrically controllable permanent magnets with very short excitation periods.

The piezo-active materials used are piezo-electrical and piezo-magnetic materials, the former being excitable electrically and the latter magnetically. With regard to the longitudinal change which can be achieved the piezo-electrical materials are superior to the piezo-magnetic materials and are, therefore, preferred.

Important piezo-electrical materials are monocrystalline substances of quartz ($SiO_2$), cadmium sulfide (CdS), zinc oxide (ZnO), cadmium selenide (CdSe) and piezo-electrical ceramics, e.g., of polycrystalline barium titanate ($BaTiO_3$), lead titanate/zirconate ($PbTi_xZr_{1-x}O_3$) and potassium sodium niobate ($K_{0.5}$, $Na_{0.5}$, $NbO_3$).

The usual piezo-magnetic materials are nickel and an iron/aluminum alloy with 87% Fe and 13% Al, called Alfenol, and piezo-magnetic ceramics such as Ferroxcube 7A2 and Kearfoot N51.

Under certain conditions liquid piezo-active substances can also be used which can also be mechanical mixtures of liquids and piezo-active solids.

The advantages gained with the invention consists in particular in that the use of piezo-electric elements makes it possible to achieve very short release or triggering times in the order of 1 to 2 mS and that power consumption is low. In contrast, customary mechanical triggering mechanisms have triggering times of 3 to 4 mS and electro-mechanical triggering mechanisms using an electromagnet as converter are probably even slower. These differences in times seem to be small but they form a considerable proportion of the build-up or actuation time of the shot of a fire arm, which is also of the order of several mS. The hit results achievable with a fire arm, however, improve with a reduction in build-up time for the shot.

The advantageously low power consumption, particularly of a piezo-electrical element, can be explained by the fact that only small amounts of electrical charges have to be moved to generate the required electrical field. Since the piezo-electrical materials, as is known, also possess dielectric properties they can be made into capacitors by applying conductive surface layers and thus generate the electrical field themselves if a voltage is applied to them. However, their electrical capacity is very low so that the losses are hardly noticeable on switch-off. In comparison to this, the electromagnets used hitherto consume considerably more electrical energy due to electric heat and induction losses.

In its simplest form the piezo-electrical element is a homogenous, solid body with uniform polarity.

It is also possible, as an alternative, to construct the piezo-electric element out of a hollow body closed on all sides and filled with a piezo-active liquid, but extendable elastically in one direction. The hollow body can also be closed off with a movable piston or a membrane. The special advantage of this arrangement is seen in the use of a piezo-active liquid which produces a long regulating distance in the extension part of the surrounding vessel by relatively small specific volume changes with a sufficiently large total volume of the hydrostatic system.

A further proposal provides for the piezo-electric element a layered bending bar of at least two parts or layers joined parallel to their axes of longitudinal change, the coefficients of longitudinal change of which have opposite signs or different magnitudes with the appropriate excitation. The one part contracts while the other part expands. Since neither part, however, can shift with respect to the other the whole bending bar will bend analogously to the bending of the bimetallic strip with temperature changes. This entails the advantage of a considerably greater deflection than with the pure longitudinal expansion or contraction of a homogenous piezo-electric element. This deflection is then used to unlatch the shot-triggering element thereby releasing it.

In the simplest case the layered bending bar can consist of a single-piezo-active part and of a support strip with relatively low flexural strength, mounted on it with its wide side. The support strip should be made of high-tensile piezo-neutral material such as, e.g., spring steel. Since the support strip will resist the longitudinal changes of the excited piezo-active part due to its high tensile strength but, on the other hand, will offer only very little resistance to bending, the whole bending bar will bend.

If a stronger bending bar is required, it is suggested to place one each or even several piezo-active strips on both longitudinal sides of the support strip. In this case care must be taken, however, as with a bending bar without support strip, that the piezo-active strips on one side expand or contract in the opposite direction to the strips on the other side of the support strip. This requirement can be fulfilled in two ways. On the one hand, by polarizing all piezo-active strips in the same direction and activating each side of the bending bar from its own force field the polarity of which is opposite to that of the forcefield for the respective other side. The other possibility consists in reversing these physical conditions, i.e., that the piezo-active strips on each side of the bending bar are excited by the same force field but the polarity of the strips is different from side to side.

The piezo-active elements described hitherto can be manufactured both of piezo-electric and of piezo-magnetic materials and accordingly must be excited electrically or magnetically.

For a further preferred embodiment of the piezo-active element, however, a piezo-electric material is used exclusively. The piezo-electric element is here a bending bar containing on its inside either metal inserts extending longitudinally or bores with electrically conductive walls and in which the expansion and contraction zone is polarized oppositely by a single application of an electric voltage between the outer, electrically conductive bar surface and the internal metal inserts or bores. This type of construction has the advantage that the bending bar can consist of one piece with the exception of any metal inserts, and can be produced, e.g., by sintering or extrusion, and its material is homogeneous. In this way joints are avoided in the central region subject to shearing and flexural stresses, improving the fatigue strength of the bending bar.

Independently of the type and construction of the piezo-active elements, apart from the natural case of using only a single piezo-element in a triggering mechanism, it is also possible to use several piezo-active elements simultaneously. Such a multiple structure can form a parallel circuit in which several piezo-electric elements are arranged side by side. The parallel circuit is to be recommended in the case where the power of the individual piezo-active element is insufficient for triggering and the number of elements used is to be increased. In this arrangement the deflection of the whole structure, however, remains as great as that of a single element.

In contrast the deflection can be increased, with the power remaining the same, by putting several piezo-elements in series with each other, the individual elements being arranged behind one another. Both structures can be combined advantageously in such a way that, e.g., groups of piezo-elements in series are arranged in parallel with each other, and vise versa.

For the triggering mechanism according to the invention different types of signal receivers can be provided which function primarily in dependence of the type of signal to be received. The usual shot-triggering signals are mechanical magnitudes such as distances and forces or combinations of the two. It also appears possible to use acoustical signals. Thus, only mechanical signals produced, as a rule, by the user of a fire arm with his index finger and transferred to a triggering lever, also called trigger, or to a key of the triggering mechanism, are of significance. This process is well suited also for inputting a signal into the signal receiver of the triggering mechanism according to the invention.

The important factor in the conversion of the mechanical shot-triggering signal into an electrical signal is that the conversion takes place very rapidly with a certain threshold value of the mechanical signal and that the electrical signal has a very steep leading edge.

In the electro-mechanical triggering mechanisms known hitherto the signal receiver is in most cases a microswitch with electrical contacts which either open or close when the input signal reaches a certain threshold value. The resulting electrical signal can be used to feed and actuate an electro-mechanical converter directly.

In contrast to that, for the electro-mechanical triggering mechanism a so called reed switch is preferred. This comprises two elastic contact reeds fused into a glass envelope with non-oxidizing gas and connecting leads going through to the outside. In most cases the contact points are covered with precious metal in order to improve their electrical conductivity. The contact reeds and their terminal ends consist of ferromagnetic material so that they conduct the magnetic flux on approach of a small permanent magnet located outside the glass envelope and the contact reeds close quite suddenly when a certain field strength is reached. The permanent magnet is either attached to the control element actuated by the user and moved in relation to the fixed reed switch, or vice versa. It could also be useful to move both parts in opposite directions in order to increase their relative velocity. Since the movement of the control element which can be, e.g., a normal trigger finger, is frequently only very slow when triggering a shot, a mechanical multiplication element can be connected which accelerates the movements and to which the permanent magnet or reed switch is to be connected, if necessary.

In comparison to the microswitch the reed switch has the advantage of dust- and air-tight encapsulation, uniformly good contact making, freedom from bounce with mercury-wetted contacts and contact-less transmission of energy. The latter characteristic produces more favourable constructional installation conditions.

Apart from the reed switch, however, the signal transducers described in the following can also be used, all of which convert a mechanical distance or force signal into an electrical signal which must be amplified and/or converted, however, in order to be usable in the following electro-mechanical converter. The operational unit required for this can be integrated into the signal receiver.

Distance signals are introduced into the signal receiver for distance signals either mechanically or contactless. Mechanically coupled signal transducers are, e.g., variable capacitors and potentiometers. For a signal input they also require certain adjusting forces which, however, are only due to friction.

In contrast to that there is also a number of signal transducers working without contact in which distance signals are scanned by means of electrical fields or radiation.

These can be photo-electric units consisting of light emitter and light receiver (photo cells), semiconductor elements controlled by magnetic fields or so-called approach switches. Semiconductor elements depending on magnetic fields, used customarily, are field plates and magnetic diodes.

Field plates are magnetically controlled resistors the controllability of which is based on the Hall effect. An increasing magnetic field strength increases their resistance. Similarly, the behaviour of the magnetic diode is based on processes related to the Hall effect.

Approach switches work in quite a different manner. These are signal transducers forming an electrically resonant circuit made up either of LC or of RC sections, which is detuned to produce a switching action either by the approach or the removal of a suitable body. In the inductive approach switch the body must be electrically conductive while it is an electrical insulator in the case of the capacitive approach switch.

Suitably, signal transducers for distance signals are used in electrical triggering mechanism allowing a relatively great releasing distance. These are triggers with a trigger slack amounting to a multiple of the actual critical trigger travel. In this arrangement, of course, an artificial triggering resistance—the socalled triggering weight—and triggering point can be created which imitate the nominal characteristics known from mechanical pressure-point triggers.

If the triggering mechanism is to be constructed, however, as a direct trigger, i.e., with a very short releasing distance and without a triggering point, signal transducers for force signals are much more suitable. For these signal transducers only very short or no force strokes are required. The preferred element for this is a monolithically integrated touch key. This is an active electronic component with integrated circuit, the amplifier of which is actuated by a sensor area being touched and closing its drive circuit. To trigger this circuit it is already sufficient to touch the sensor with a finger tip but also, of course, with an electrically conductive object. A monolithically integrated touch key delivers with each touch, independently of the contact force and the transfer resistance, a specific electric signal with values which are always identical. The contact force need only be very small. In order to match the requirements of practical application the contact force can be increased, of course, and it is particularly advisable to work with an appropriate bias load at the contacting part so that a shot is not triggered already with vibrations and a light touch on the trigger.

Another advantageous signal transducer for force signals is a piezo-resistive semiconductor component. This element changes its electrical resistance under the influence of force. At a certain threshold value of the current controlled in this way the following amplifier stage delivers a specific electric signal.

These two signal transducers for force signals last described can be used just as well in places where the force signal is provided with greater travel. This is the case with pressure point triggering mechanisms. In these the force signal gets to the signal transducer only after passing through a certain distance. Its arrival should be coincident with the rise in force on reaching the pressure point, or follow it immediately.

Many signal transducers and their connected amplifier circuits require an electrical energy supply not only for performing their functions but also to maintain their operational readiness. In itself, this is disadvantageous, of course, since this soon exhausts the energy source if it can only supply a limited amount of current. Since it is desired, however, to be independent of a powerful energy source outside of the fire arm, only small dry cells or accumulatores to be housed somewhere in the fire arm can be considered. It is preferable to use accumulators because they can be recharged.

In order to conserve as much energy as possible during use it is suggested that the power supply for the signal receiver and any operational unit is switched on immediately on operation of the trigger finger, and interrupted after its release, by an electric switch controlled by the trigger finger of the triggering mechanism. In this way electric energy is consumed only during the operating cycles of the triggering mechanism. Particularly, suited to this are triggering mechanisms with trigger slack because in these the times of switch-on and of the input of the shot-triggering signal are spaced further apart than with direct triggers.

BRIEF DESCRIPTION OF THE DRAWINGS

In the drawings several embodiments of the invention are shown and are thereafter explained in greater detail. The drawings show in diagrammatic representation in.

DETAILED DESCRIPTION OF PREFERRED EMBODIMENTS

Figure 1:
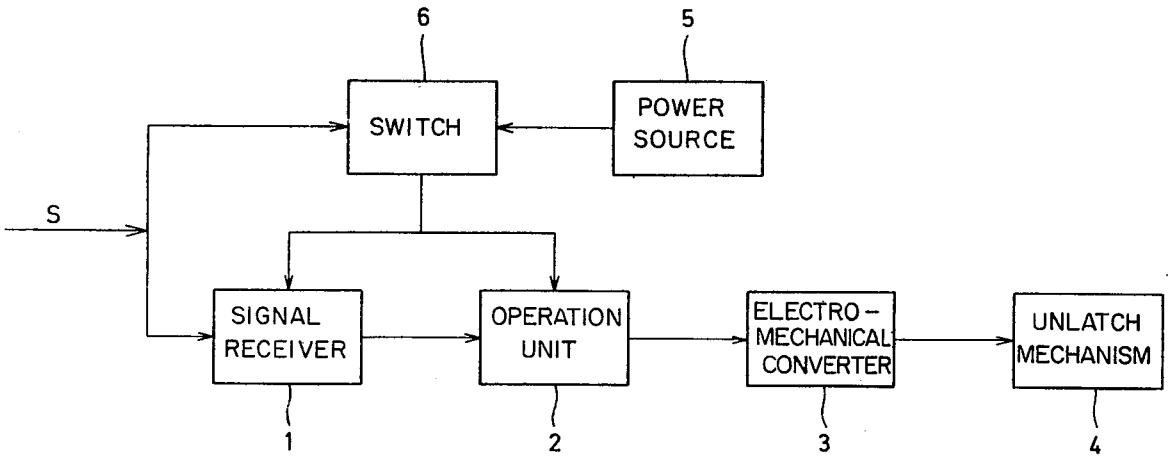
FIG. 1, a block diagram of the tirggering mechanism.

FIG. 1 shows a signal receiver 1 of the triggering mechanism which converts a mechanical shot-triggering signal S input by the user of the fire arm into an electrical signal. An operational unit 2 is used to amplify and/or convert this electrical signal, e.g., into a rectangular pulse of the required amplitude. The output signal of the operational unit 2 is fed to an electro-mechanical converter 3 which converts it into a mechanical magnitude—e.g., motion or force. The operational unit 2, however, can be omitted and if left out of the output signal of the signal receiver 2 is present already in a strength and form suitable for the electro-mechanical converter 3. In such a case the converter 3 is fed directly by the signal receiver 1. On the other hand, the situation also sometimes exists that the signal receiver 1 and the operational unit 2 are combined into a single assembly for practical reasons.

An unlatching mechanism 4 including at least a short-triggering element, is placed at the end of the series of functional units and is actuated by the electromechanical converter 3.

A power source 5 is provided to supply energy and feeds its current to the active components 1 and 2 via a switch 6. The switch 6 can be operated by hand independent of a shot-triggering signal S. In order to conserve energy and to be able to handle the triggering mechanism more comfortably it is advantageous, however, to control it by the shot-triggering signal S itself in such a way that it switches on the current shortly before the signal S causes the signal receiver 1 to react, and switches it off when signal S disappears.

Figure 2:
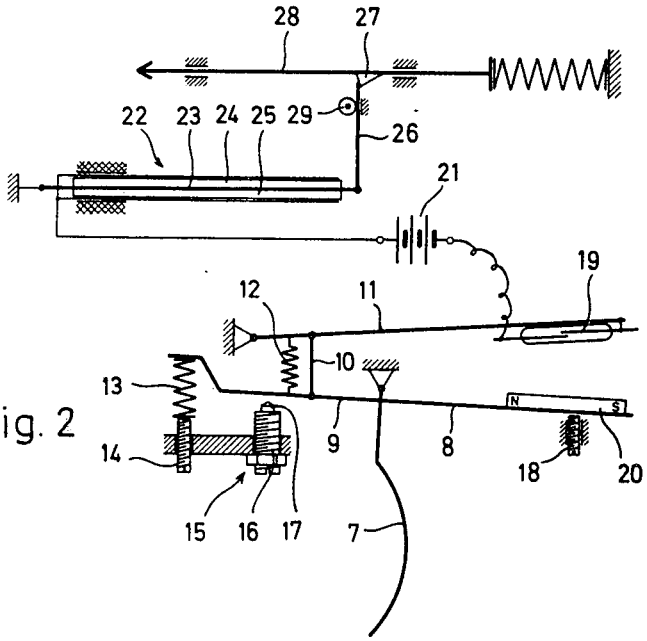
FIG. 2, a first embodiment of the tirggering mechanism in a state ready for triggering.

FIGS. 2 shows that the triggering mechanism in each case is equipped with a trigger finger 7 to which two arms 8 and 9 are attached which are preferably aligned with each other and extend in opposite directions to each other, in the vicinity of its pivot point. In the embodiment according to FIGS. 2 and 3 the arm 9 is connected to be hinged with a lever 11 hinged on one side, via a connecting rod 10, forming in this way a crank mechanism. The lever 11 extends approximately parallel to arm 8 of the trigger finger 7 and moves in the opposite direction of rotation to the latter. In order to minimize the play in the pivots of the connecting rod 10 joining the arm 9 to the lever 11 a spring 12 is provided. In addition another spring 13 acts on arm 9 and its tension can be adjusted to different amounts by means of an adjusting screw 14 for changing the triggering weight. A pressure point device 15 also works in conjunction with arm 9 and consists of a hollow screw 16 screwed into the triggering housing and having a springloaded pressure bolt 17 inserted to slide in it. The hollow screw 16 is also used as trigger stop. An adjusting screw 18 is provided as end stop for the arm 8 of trigger finger 7.

At the free ends of lever 11 and of arm 8 a reed switch 19 and a permanent magnet 20 are mounted opposite to one another. This reed switch 19 and the permanent magnet 20 are mounted opposite to one another. This reed switch 19 and the permanent magnet 20 form the signal receiver 1. In the wider sense, however, the trigger lever mechanism with parts 7 to 18 is also included as part of the signal receiver 1 because the technical conditions necessary for proper and precise signal reception are fulfilled only by them.

One of the two contact reeds of the reed switch 19 is connected to earth and the other one via a flexible lead to one pole of an electrical power source 21. This power source 21 consists of a dry cell or an accumulator with a following voltage amplifier. Its second pole is connected electrically with a piezo-electric bending bar 22 forming the electro-mechanical converter 3. The bending bar 22 is clamped with one end firmly and electrically insulated into the trigger housing. It consists of a central thin support strip 23 of spring steel and of two piezo-electric parts 24 and 25 bonded to its wide side and equipped on their external sides extending parallel to each other with an electrically conductive coating. This layer is connected to the second pole of the power source 21, the support strip 23, on the other hand, being connected to earth. The parts 24 and 25 are of identical piezo-electric polarity (see also FIG. 8).

The support strip 23 projects a little from the free end of the bending bar 22 from which a latch 26 is hingedly connected which latch engages the back of a nose 27 of a spring-loaded shot-triggering element 28 included in a cocked triggering mechanism, and thus holds it. The nose 27 has a support area which is inclined in relation to latch 26 and the purpose of which is to substantially compensate for the frictional forces occurring between the latch 26 and the nose 27 by downward acting forces, thus requiring only a small unlatching force. The latch 26 is supported transversely by roller 29. The shot-triggering element 28 will be a firing pin with fire arms and a compression piston or valve-opening impact part with compressed air arms.

The operation proceeds as follows: With the triggering mechanism ready to be triggered, the trigger finger 7 is pulled counterclockwise until its arm 9 touches the pressure bolt 17 of the pressure point device 15 and the user is notified in this way by a temporary stopping of the trigger finger 7 and a rise in the triggering weight that the pressure point device 15 has been reached and triggering of the shot is imminent if the triggering movement is continued. In this phase permanent magnet 20 and reed switch 19 have approached to within a critical distance of each other. Any further small movement toward each other will now lead, by virtue of the effect of the magnetic forces on the two, as yet open, elastic contact reeds of the reed switch, to a sudden springing together and hence closing the circuit to the piezo-electric bending bar 22. Since the electric capacity of the bending bar is extremely small it reacts practically without delay and immediately bends away from the shot-triggering element 28, thus pulling the latch 26 from its blocking position and releasing the shot-triggering element 28.

Figure 3:
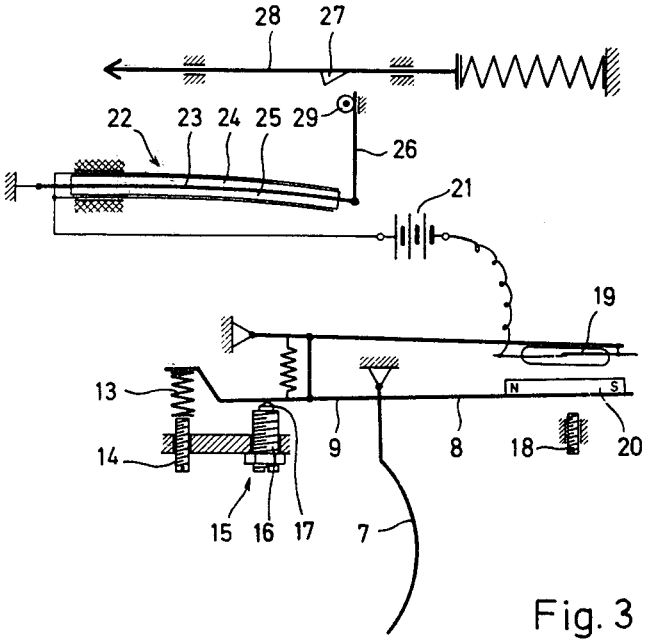
FIG. 3, the triggering mechanism according to FIG. 2 after triggering.

FIG. 3 shows the mechanism at the moment the shot is triggered.

Figure 4:
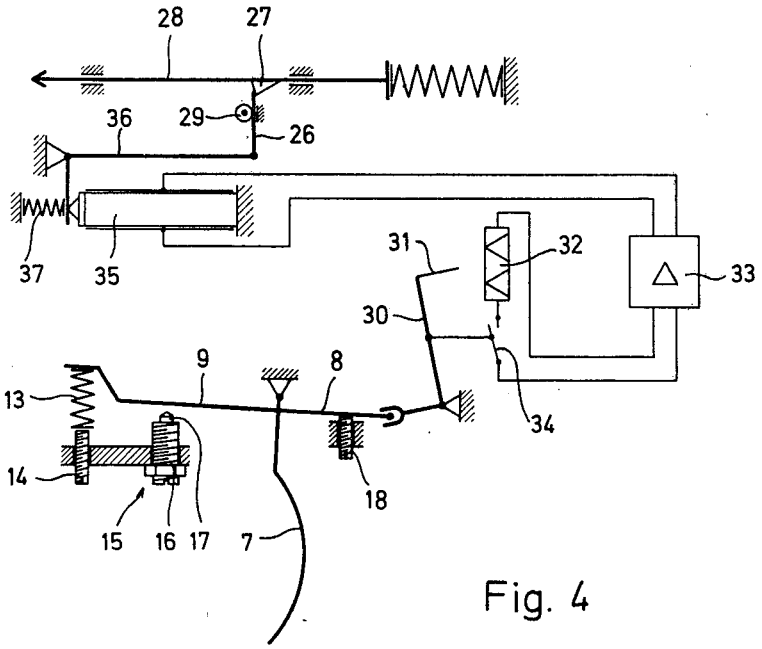
FIG. 4, a second embodiment of the triggering mechanism teady to be triggered.

FIG. 4 shows a partially different embodiment of the triggering mechanism. Here the trigger finger 7 works via its arm 8 in conjunction with an angle lever 30 to the longer leg of which a leaf 31 is attached. This leaf 31 has the function of an interrupter for a photo-electric unit 32 arranged within its range of movement and consisting, as usual, of a light emitter and a light receiver. In the arrangement shown the leaf 31 would interrupt partially or wholly a beam of light between the light emitter and the light receiver with the presence of a mechanical shot-triggering signal, and thus trigger an electrical signal generated in the receiver. The same effect can be achieved with a photo-electric unit in which the leaf 31 moved by the shot-triggering signal frees the light beam first blocked by it. An amplifier 33 is provided to amplify this signal to a value required for the piezo-electric element.

The angle lever 30 is also coupled to an electric interupt switch 34 in such a way that if the trigger finger 7 is actuated counterclockwise this switch 34 is closed before the leaf 31 enters the light zone of the photo-electrical unit 32. This guarantees that the photo-electric unit 32 and the photo current amplifier 33 following it are supplied in time with power. Current is also saved, however, since switch-on occurs shortly before and only during the triggering movement, and switch-off occurs immediately after trigger finger 7 is released again. The switch 34 or a similar device can also be used for switching all other signal receivers, described here, on and off.

FIG. 4 the electromechanical converter 3 is a piezo-electric ceramic body in the form of a homogeneous, bar-shaped and solid body 35. It is polarised in one uniform direction and reacts with changes in length to changes in electrical load. The occurrence of expansions or contractions is dependent on the polarity of the load. It is supplied with electric voltage via leads from amplifier 33, this voltage being applied to the longitudinal sides of body 35 by means of two conductive layers placed opposite to one another. It is firmly supported at one face, the second face being in contact with an angle lever 36 supported to be pivoted and pressed against this freely movable face by a spring 37. The other, longer leg of the angle lever 36 is hinged at its end at latch 26.

If now, in consequence of a shot-triggering signal converted in the photo-electric unit 32, the amplifier 33 feeds a steeply rising voltage of appropriate polarity to the piezo-electric body 35, this will expand and deflect the angle lever 36 from its rest position. Latch 26 is pulled away in the direction of unlatching and releases the shot-triggering element 28.

Figure 5:
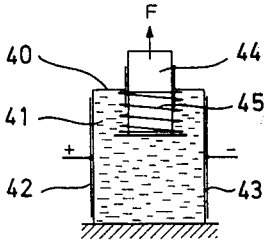
FIGS. 5 to 7 various piezo-active elements with piezo-active liquid.
Figure 6:
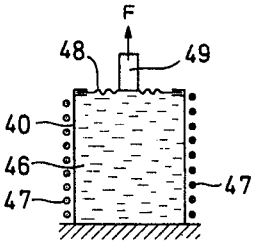
Figure 7:
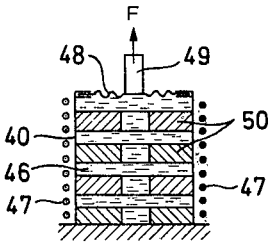

FIGS. 5 to 7 show three further types of piezo-active elements. These are formed of hollow bodies 40, closed on all sides and filled with a piezo-active liquid. Under the effect of an electric or magnetic force field the volume of the liquid changes in a way which can be utilized for generating a control movement.

FIG. 5 shows a hollow body 40 of non-conductive material, filled with a piezo-electric liquid 41 and covered with electrodes 42 and 43 on two of its outer surfaces, between which the electric field can be generated. From the side opposite to its support side a sealed movable piston 44 projects into the hollow body 40 and is pressed inward by a spring 45 so that the liquid 41 is under a certain excess pressure with respect to the atmosphere, and no air can enter. If an electric voltage is applied to electrodes 42, 43, piston 44 will move inside hollow body 40 in the direction of arrow F due to the change in volume of the liquid 41, and will actuate the unlatching mechanism, not shown here.

In the constructions of the piezo-active elements according to FIGS. 6 and 7, the hollow body is filled in each case with a piezo-magnetic liquid which reacts to magnetic force fields instead of to electric ones. Around hollow body 40 an electric coil 47 is arranged which generates a magnetic force field also in the interior of hollow body 40 when a current passes through the coil. So that the lines of force can penetrate the walls of the hollow body they must consist of non-magnetic material. The wall of hollow body 40 opposite its support area is constructed as extendible membrane 48 with a plunger 49. At the plunger 49, movements of membrane 48 can be picked up which are caused by changes in the volume of the piezo-magnetic liquid 46.

According to FIG. 7, the hollow body 40 also contains several perforated disks 50 of solid piezo-magnetic material, apart from the liquid 46. The expansions or contractions of these disks 50 caused by a changing magnetic force field are transferred by the incompressible liquid 46 to membrane 48 which rises or sinks correspondingly. In this construction the liquid 46 could also be piezo-neutral and could be, e.g., an oil without the piezo-active element loosing thereby in its effect.

Figure 8:
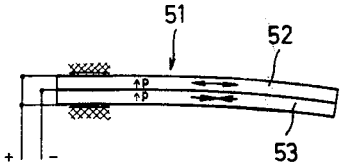
FIGS. 8 and 9, forms of piezo-active elements constructed as bending bars.
Figure 9:
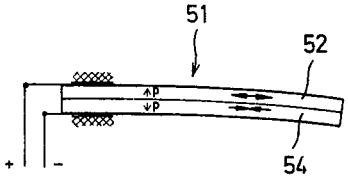

FIGS. 8 and 9 each show a layered piezo-electric bending bar 51 consisting of two parts 52 and 53 or 54 joined parallel to their longitudinal axes of change.

In FIG. 8 the polarities P of the piezo-electric parts 52 and 53 point in the same direction. They each require, therefore, electric fields of opposite polarity for an excitation which is to produce an expansion of part 52 and a contraction of part 53 according to the arrows at the center. This is achieved by connecting the two outer surfaces to the positive pole of a power source and the inner surfaces to its negative pole.

In FIG. 9 the polarity of part 54 is opposite to that of part 52. This is why here only a uniform electric field is used for excitation, generated by connecting the two outer surfaces to positive and negative. So that the electric charges are distributed well the respective surfaces to be connected are covered with a conductive coating.

Figure 10:
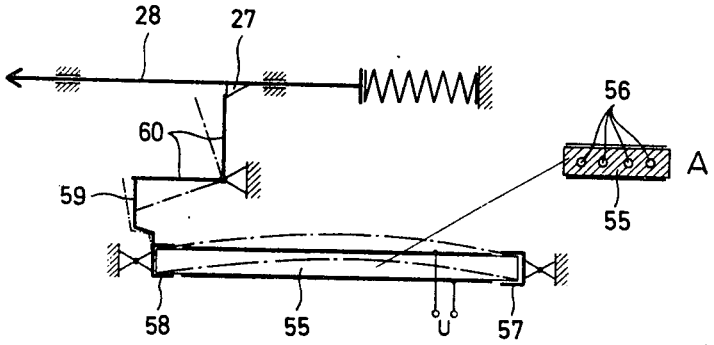
FIG. 10, another bending bar-shaped piezo-active element with unlatching mechanism.

FIG. 10 shows an embodiment with a further piezo-electric bending bar 55. It consists of a homogeneous body with several bores 56 extending along its longitudinal axis 56 (see cross-section A). Its two ends are mounted in two mounts 57 and 58 supported by hinges, mount 57 allowing axial compensating movements of the bending bar 55. The tension and pressure zone of the bending bar 55 are polarised in opposite directions by the single application of different electric voltages to the graphite-coated walls of bores 56, on the one hand, and the two conductively coated broad sides on the other hand. In order to generate a bending deflection, then, it is sufficient to apply a voltage U to the two broad sides. The bending movement causes a support 59 attached to the mount 58 to be swivelled away under an angle lever 60 holding back the shot-triggering element 28 by way of nose 27 (see dashed lines) so that this is not held any longer and thereby releases the shot-triggering element 28.

Figure 11:
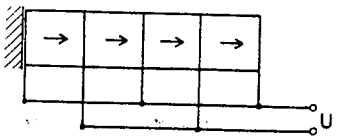
FIGS. 11 and 12, series- and parallel-connected piezo-active elements.

FIG. 11 shows a series arrangement of four similar piezo-active elements. In this arrangement their individual deflections add up to a correspondingly long travel. These arrangements are chosen if the control force of the individual piezo-active element is adequate but not its deflection.

Figure 12:
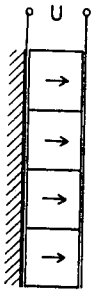

FIG. 12 shows a parallel arrangement of four similar piezo-active elements, the total controlling force being four times that of the individual force. The control travel, however, is exactly the same as that of an individual piezo-element.

Figure 13:
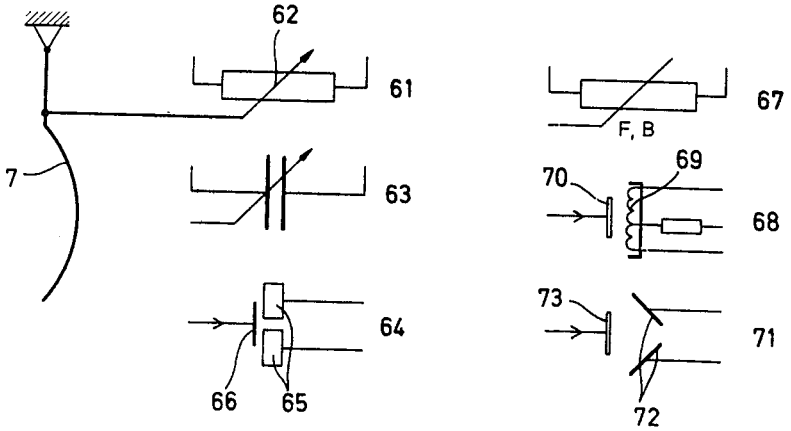
FIG. 13, various types of transducer constructions.

FIG. 13 shows in six details different signal transducers known in themselves.

A potentiometer 61 is coupled mechanically with its slider 62 to trigger finger 7. Instead of this a variable capacitor 63 or a monolithically integrated touch key 64 with a pair of contacts 65 could be used which has a high-resistance connection and can be bridged by a contactor 66. As well, a piezo-resistive semiconductor component 67 is suitable which by the action of a mechanical force F alters its electrical resistance, or a semiconductor component which is controlled by a magnetic force field B and changes its electrical resistance, e.g., a magnetic diode. The signal transducer can also be an inductive approach switch 68. It has a coil 69 to generate an alternating magnetic flux which is affected by the approach or removal of a ferromagnetic element 70, an effect used for the generation of a signal. The capacitive approach switch 71, consisting essentially of a capacitor 72 for the generation of an alternating electric field, works in a similar way. An approaching object 73 of a material with dielectric properties increases the capacity of capacitor 72 which also results in a signal.

All these signal transducers must work in conjunction with a following operational unit so that a clearly defined and amplified signal is obtained with a certain threshold value of the input signal.

We claim:

1. Electro-mechanical triggering mechanism for fire arms, comprising a signal receiver used as an input unit which converts a shot-triggering signal generated by the user into an electrical signal, and an electro-mechanical converter forming an output unit which receives the electrical signal from said input unit and acts on a shot-triggering element to trigger the shot, the improvement consisting in that the electro-mechanical converter is an electrically or electromagnetically deformable piezo-active element which is mechanically connected to said shot-triggering element.

2. The triggering mechanism according to claim 1, wherein said piezo-active element is a homogeneous solid body of uniform polarity.

3. The triggering mechanism according to claim 1, wherein said piezo-active element is a hollow body filled with piezo-active liquid and which is elastically extendible in one direction but otherwise possesses rigid walls and is closed on all sides.

4. The triggering mechanism according to claim 3, wherein the said one direction of the hollow body is closed with a piston which can be moved against the action of a spring.

5. The triggering mechanism according to claim 3, wherein the said one direction of the hollow body is closed with an elastic membrane.

6. The triggering mechanism according to claim 1, wherein said piezo-active element is a cantilevered bending bar.

7. The triggering mechanism according to claim 6, wherein said bending bar consists of at least two piezo-active layers having sandwiched therebetween a support strip with relatively low flexural strength but high tensile strength.

8. The triggering mechanism according to claim 7, wherein said piezo-active layers of the bending bar have polarities pointing in the same direction and the expansion layer of the bending bar being exposed to force fields of opposite polarity to those on the contraction layer of said bending bar.

9. The triggering mechanism according to claim 7, wherein said piezo-active layers of the bending bar have opposite polarities and each layer is exposed to the same electric or magnetic field.

10. The triggering mechanism according to claim 6, wherein the interior of said bending bar contains a series of longitudinally extending bores having electrically conductive walls; the bending bar has expansion and contraction zones and these zones are respectively polarized in opposite directions by a single application of an electric voltage between an outer electrically conductive surface of the bending bar and the conductive walls of the bores.

11. The triggering mechanism according to any one of claims 1 to 10, wherein several piezo-active elements are arranged side by side in parallel.

12. The triggering mechanism according to any one of claims 1 to 10, wherein several piezo-active elements are arranged in series behind each other.

13. The triggering mechanism according to claim 1, wherein said signal receiver includes a reed switch and permanent magnet which co-act to allow the electrical signal to be transmitted from said input unit to said output unit.

14. The triggering mechanism according to claim 1, wherein said signal receiver is a potentiometer.

15. The triggering mechanism according to claim 1, wherein said signal receiver is a variable capacitor.

16. The triggering mechanism according to claim 1, wherein said signal receiver is a monolithically integrated touch key.

17. The triggering mechanism according to claim 1, wherein said signal receiver is a piezo-resistive semiconductor component.

18. The triggering mechanism according to claim 1, wherein said signal receiver is an inductive or capacitive approach switch.

19. The triggering mechanism according to claim 1, wherein said signal receiver is a photo-electric unit consisting of light emitter and light receiver.

20. The triggering mechanism according to claim 1, wherein said signal receiver is a semiconductor element controlled by a magnetic field.

21. The triggering mechanism according to any one of claims 13 to 20, wherein the power supply for said signal receiver is activated by actuation of the trigger by means of an electric switch before said signal receiver receives said shot-triggering signal, and the power from the power supply is interrupted upon release of the trigger.

* * * * *